US006202985B1

(12) United States Patent
Chong et al.

(10) Patent No.: US 6,202,985 B1
(45) Date of Patent: Mar. 20, 2001

(54) APPARATUS FOR REMOVAL OF VAULT LIDS AND OTHER HEAVY COVERS

(75) Inventors: Ian M. Chong, Seattle; Randolph F. Miller, Mt. Vernon; Jeffrey B. Johnson, Bellevue, all of WA (US)

(73) Assignee: Group 3 Manufacturing, Inc., Mt. Vernon, WA (US)

( * ) Notice: Subject to any disclaimer, the term of this patent is extended or adjusted under 35 U.S.C. 154(b) by 0 days.

(21) Appl. No.: 09/353,331

(22) Filed: Jul. 14, 1999

Related U.S. Application Data

(60) Provisional application No. 60/092,709, filed on Jul. 14, 1998.

(51) Int. Cl.[7] ..... B66F 3/00

(52) U.S. Cl. ..... 254/131

(58) Field of Search ..... 414/689.3, 444, 414/494; 294/17, 18, 15; 280/47.27; 254/131, 120, 8 R

(56) References Cited

U.S. PATENT DOCUMENTS

| | | |
|---|---|---|
| 2,600,577 | 6/1952 | Roe . |
| 3,198,362 | 8/1965 | Berg . |
| 3,275,299 | 9/1966 | Meshew . |
| 4,365,925 | 12/1982 | Gritz . |
| 4,488,706 | 12/1984 | Kono . |
| 4,512,554 | 4/1985 | Racine . |
| 4,653,728 | 3/1987 | Mochizuki et al. . |
| 4,662,607 | 5/1987 | Mochizuki et al. . |
| 4,826,388 | 5/1989 | Golding . |
| 4,838,521 | 6/1989 | Moisan . |
| 4,852,855 | 8/1989 | Moisan . |
| 5,292,107 | 3/1994 | Chick . |
| 5,462,385 | 10/1995 | Mohlengraft . |

*Primary Examiner*—Robert C. Watson
(74) *Attorney, Agent, or Firm*—Todd N. Hathaway

(57) ABSTRACT

A tool for lifting and removing heavy lids, such as manhole covers and similar articles. The tool includes an elongate lever with a handgrip at the upper end and a pivot head at the lower end. Wheels on the pivot head provide a pivot axis, with a hook being mounted in front of the pivot axis and a footplate being mounted behind the axis. The hook is inserted in an opening in the lid, and the lid is then lifted and removed by pulling back on the lever and stepping down on the footplate. After removal, the lid can be transported by rolling the assembly over the ground using the wheels. The invention thus facilitates removal and installation of heavy lids with minimal strain and potential injury to the operator.

10 Claims, 7 Drawing Sheets

APPARATUS FOR REMOVAL OF VAULT LIDS AND OTHER HEAVY COVERS

This application claims priority from Provisional Application Serial No. 60/092,709, filed Jul. 14, 1998.

BACKGROUND OF THE INVENTION a. Field of Invention

The present invention relates generally to apparatus for removal of heavy covers and lids, and, more particularly, to an apparatus for removal and replacement of vault lids, manhole covers, and similar lids/covers with minimal physical strain on the operator.

b. Related Art

Vault lids, manhole lids, grates, and similar heavy covers (referred to collectively in this description and the appended claims as "lids" ) have traditionally been removed either by hand (which is very difficult) or using only very basic tools, such as pry bars and hooks.

When using a pry bar, the operator tries to find a hole or notch in the lid into which the end of the bar can be wedged, and then attempts to pry the heavy lid off of the opening. This requires a great deal of physical effort, and presents a very real possibility of the operator suffering a strain injury. Moreover, the lid may not have any seam, notch or other feature near its edge which is suitably sized or shaped for the end of the pry bar, so that the end of the bar may damage the lid and/or the surrounding lip in the course of the efforts to get the lid off the opening.

Furthermore, the ends of conventional pry bars offer little grip and very poor stability when removing lids. As a result, the bar can easily slip off of the lid and allow it to drop, very possibly causing damage to the lid and/or access opening, or serious physical injury to the operator. Moreover, operators often resort to using some form of makeshift, ill-shaped fulcrum for the pry bar (such as a rock or piece of wood) in order to generate the necessary leverage, further increasing the likelihood of an accident.

Still further, pry bars do not provide the operator with any convenient means for moving the lid out of the work area once it has been pried from the opening. As a result, the heavy lid is typically "manhandled" out of the way, presenting further opportunities for back injuries and smashed fingers.

The second type of lid removal tool in common use consists of a simple lifting hook. The operator inserts the hook through an opening or ring in the lid, and then heaves the lid up and away from the access hole. Again, this involves considerable exertion and risk of back injury, hernia, or spinal compression, especially since the operator must bend over the heavy lid when removing it with a hook. Moreover the hook, like the pry bar, offers no easy way to transport the lid after it has been removed.

Accordingly, there exists a need for a lid removal tool that permits easy and convenient removal and replacement of heavy lids and similar covers without requiring heavy lifting, so as to provide improved operator comfort and reduced risk of injury. Furthermore, there exists a need for such a lid removal tool that provides improved stability when lifting and lowering the lid, so as to reduce the risk of the lid slipping off and falling. Still further, there exists a need for such a tool which provides for easy and convenient transportation of the lid away from an opening after removal. Still further, there exists a need for such a tool which is capable of removing/replacing various vault lids, manhole covers, grates and other types of covers without causing damage to such covers or the surrounding openings.

SUMMARY OF THE INVENTION

The present invention has solved the problems cited above, and is an apparatus for lifting and removing heavy lids and similar articles.

In a broad sense, the apparatus comprises: (a) an elongate lever arm member having a handgrip portion at an upper end thereof for application of force in a rearward and downward direction, (b) a pivot head member mounted to a lower end of the lever arm member and having at least one wheel member which is configured to rest on an underlying surface so as to provide a pivot axis for the head member, (c) a foot plate member mounted to a rearward side of the pivot head member for application of force in a downward direction, and (d) a hook member mounted to a forward side of the pivot head member for engaging and lifting a lid or similar article as the head member pivots about the wheel axis in response to application of the forces in the downward and rearward directions to the lever arm and footplate members of the apparatus.

The at least one wheel may also form a rolling axis for transporting the lid after lifting and removal, by rolling the pivot head member along the underlying surface while the lid is suspended from the hook member thereon.

The apparatus may further comprise at least one stabilizer portion for arresting movement of the lid during lifting and removal, and for preventing movement of the lid during transport. The stabilizer portion may comprise at least one notch area at the forward side of the pivot head member for receiving and engaging a rearward edge of the lid as the lid is being lifted and removed. The notch area may comprise at least one generally vertical face portion for abutting an outer edge of the lid so as to arrest movement of the lid in the rearward direction, and at least one generally horizontal face portion for abutting an upper surface of the lid so as to arrest movement of the lid in the upward direction.

DETAILED DESCRIPTION a. Overview

Figure 1:
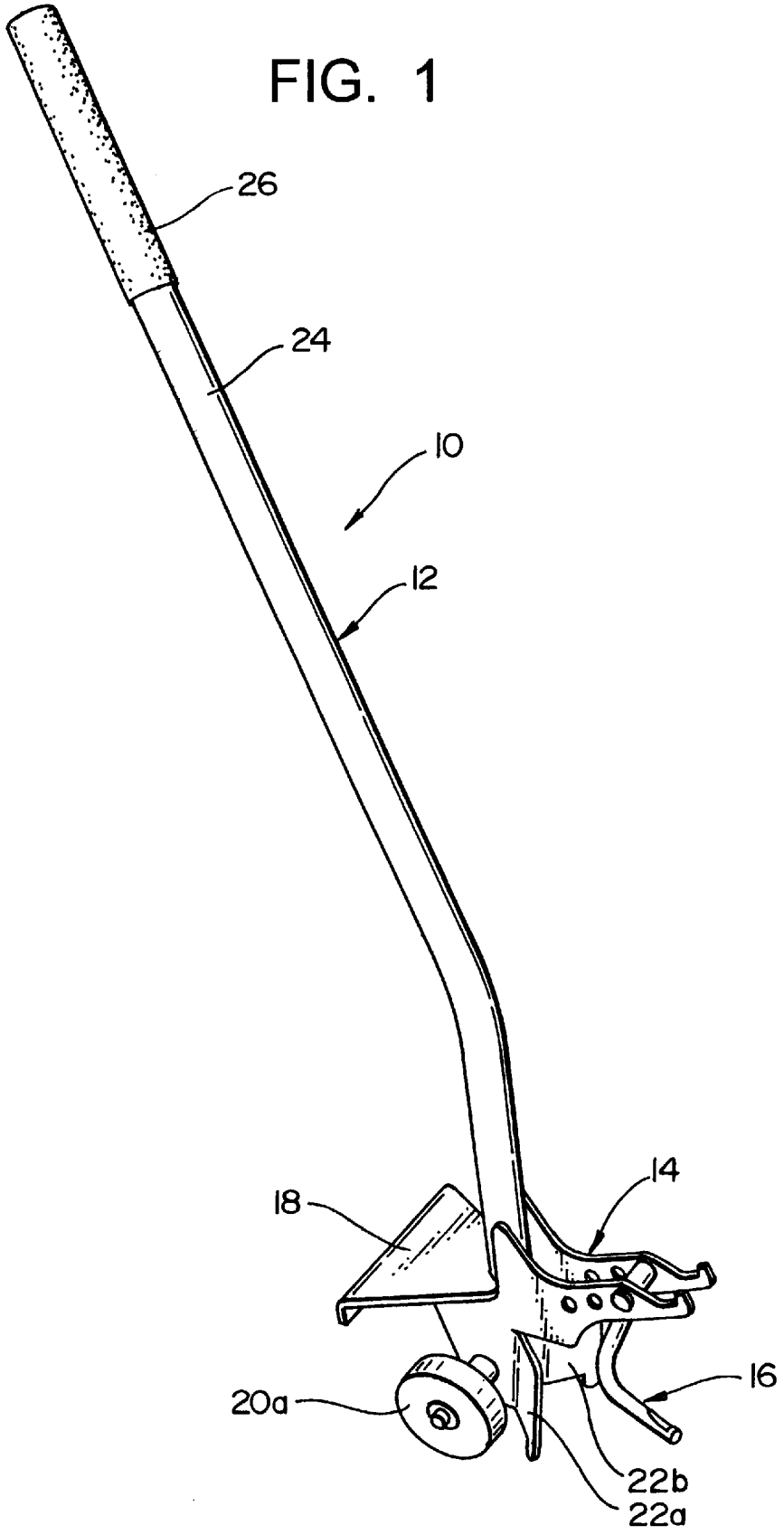
FIG. 1 is a perspective view of a lid removal tool in accordance with the present invention, showing the elongate lifting handle, and the pivot head which provides a fulcrum for raising the lid and wheels for transporting the lid to and from the opening.

FIG. 1 shows a lid removal tool 10 in accordance with the present invention. As can be seen, this includes three principal components: an elongate handle member 12, a pivot head 14, and a hook member 16.

Figure 2A:
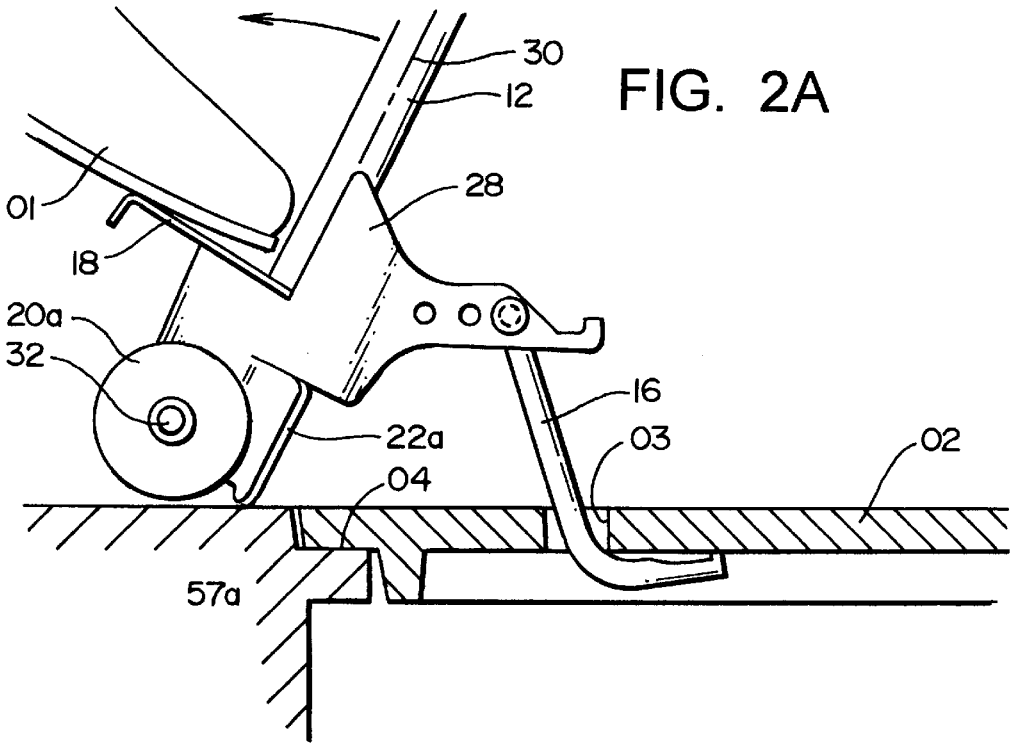
FIGS. 2A–2B are sequential, elevational views of the lower end of the lid removal tool of FIG. 1, showing this being used to remove and transport an exemplary vault lid.
Figure 2B:
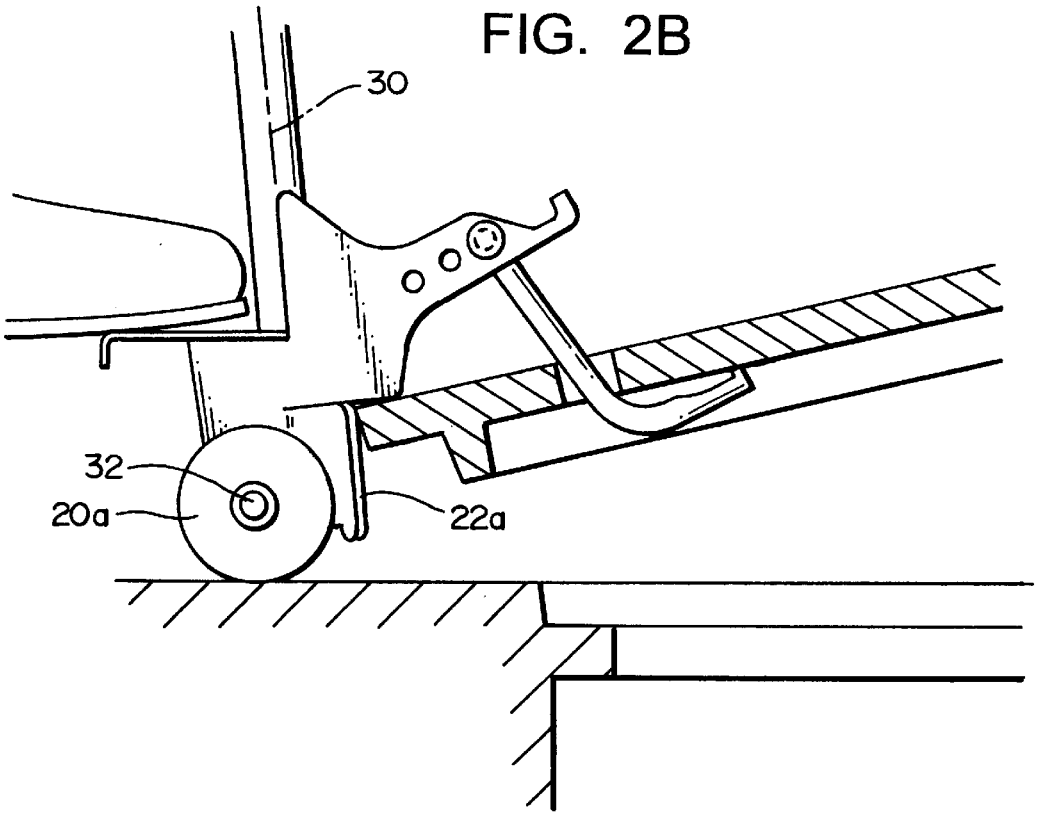

The operation of the tool is illustrated in FIGS. 2A, 2B, which show the foot of an operator 01 who is removing an exemplary manhole lid 02. As can be seen, the operator inserts the hook member 16 through a lift hole 03 in the lid and then pulls the handle member 12 rearwardly and downwardly through an arc, as indicated by the arrow, so that the hook member engages the lid and lifts it from its seat 04. Simultaneously, the operator places his foot on plate 18 at the back of the head assembly and presses downwardly and forwardly using his body weight. In combination, these forces cause the head assembly to pivot on the fulcrum which is formed by wheels 20*a*, 20*b*, raising the hook at the front of the assembly and the lid which is supported therefrom. The leverage provided by the long, generally vertical handle member, combined with the effective employment of body weight, thus enables the operator to raise the lid with a minimum of physical exertion.

As the lid is raised, the edge nearest the tool swings upwardly and rearwardly until it strikes and comes to rest against stabilizer plates 22*a* 22*b* at the front of the pivot head. The stabilizer plates are spaced apart and are generally level with one another in the horizontal plane, and consequently stabilize the lid and prevent any unsafe tilting or wobbling movement as it is being lifted and/or transported.

In addition to providing the fulcrum for the pivot head, wheels 20*a*, 20*b* also enable the operator to easily and quickly transport the lid away from the opening after it has been removed. To do this, the operator simply maintains the downward pressure on the handle after the lid has been lifted out of the opening, and rolls the entire unit away while steering with the handle. As can be seen in FIG. 1, the upper portion 24 of the handle is preferably bent somewhat to the rear, away from the hook member, for an improved, less awkward angle when lifting the lid, and also to provide additional ground clearance at the back of the footplate when transporting the lid.

b. Structure

The handle member of the tool may suitably be formed of tubular metal material, although it will be understood that other types of material may be used in various embodiments of the invention. The handle member 12 is preferably provided with a resilient sheath or handgrip 26 at its upper end for ease of handling and enhanced operator comfort.

As is shown in FIGS. 2A–2B, the pivot head is mounted to the lower end of the elongate handle member, and includes the footplate 18, the pivot/transport wheels 22*a*, 22*b*, and a hook frame 28.

The footplate is mounted to the hook frame generally behind the handle member and above the wheels 22*a*, 22*b*. The footplate extends in a generally horizontal direction (when the tool is upright), and preferably widens towards its rearward edge and is provided with surface texturing so as to provide a secure, stable area for applying foot pressure.

As is also shown in FIGS. 2A–2B, the rotational axis of the pivot/transport wheels is located beneath the footplate 18, behind the long axis 30 of the handle, and extends generally perpendicular to the hook frame 28. In the embodiment which is illustrated, the wheel axle 32 extends through an axle support tube 34 which is mounted across the bottom of hook frame 28.

Figure 3:
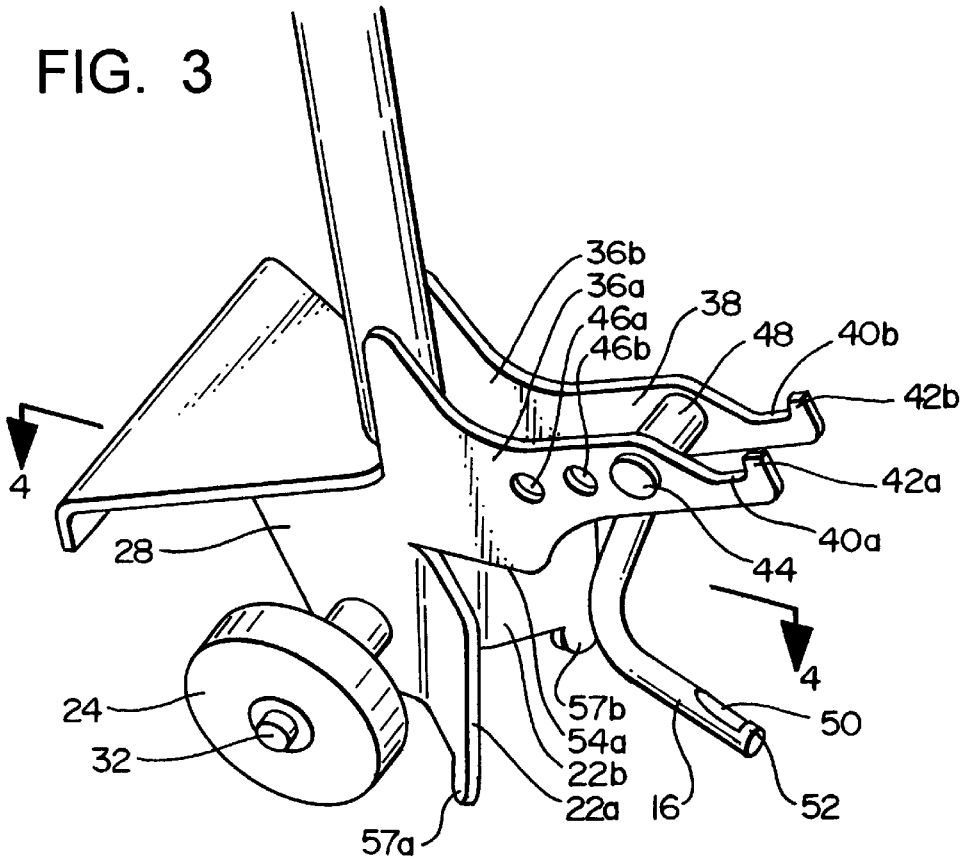
FIG. 3 is a perspective view of the lower end of the removal tool of FIGS. 1–2, showing the configuration of the pivot head and hook member in greater detail.

As is shown in FIG. 3, the hook frame itself is formed of two generally parallel plates 36*a*, 36*b* which are mounted on opposite sides of the shaft of the handle member. As was noted above, the footplate is mounted across the rearward end of the plates and the axle tube is mounted across the bottom. At the forward end, in turn, the plates extend to form a lifting arm 38 which supports the pivoting hook member 16. Notches are formed in the upper edges of the lifting arm so as to form fixed upper hooks 40*a*, 40*b*, which can be used to remove lids having "D" style lifting rings or similar fittings, as will be described in greater detail below; tabs 42*a*, 42*b* at the ends of the arms help to prevent the rings or other fittings from slipping off of the hook area as they are being lifted.

The upper end of the hook member 16 is pivotally mounted to the frame 28, by means of a pivot pin 44 which extends through one of a plurality of corresponding bores 46*a*, 46*b*, 46*c* in the two plate members 36*a*, 36*b*. As a result, the lower end of the hook member can pivot as the lid is being raised, and can also be pivoted to accommodate various sizes and positions of lids and lift holes. The series of pivot bores 46*a*, 46*b*, 46*c* are set at parallel, spaced apart locations, so as to permit adjustment of the depth/distance of the hook member relative to the stabilizer plates 22*a*, 22*b*, not only to allow the location of the hook member to be adjusted to match the configuration of the lid, but also to allow for attachment of additional lifting fittings, as will be described in greater detail below.

The embodiment which is shown in FIG. 3B has a single-pronged hook member, the upper end of which has a collar portion 44 which accommodates the pivot pin and which fits closely in the gap between the two plate members so as to limit side-to-motion. A relief area 40 and end tab 42 at the lower tip of the hook member help to prevent lids from slipping off during lifting.

Figure 4:
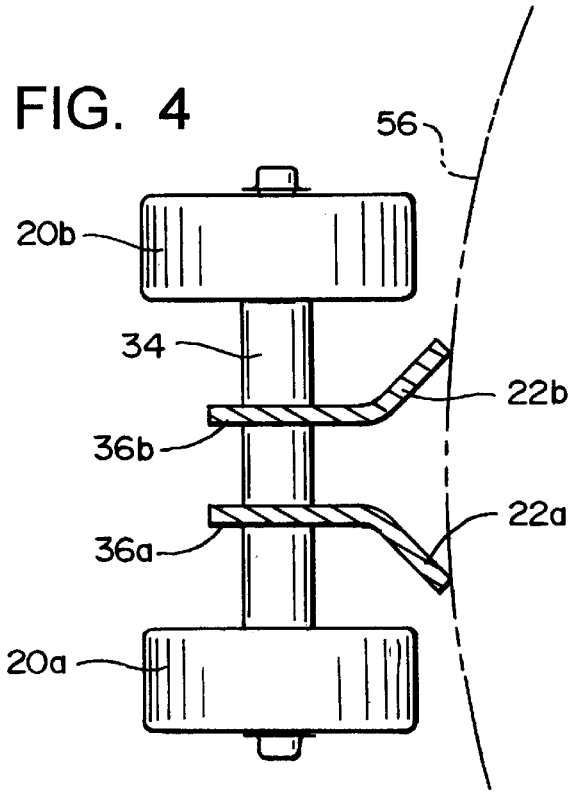
FIG. 4 is a cross sectional view, taken along line 4—4 in FIG. 3, showing the manner in which the first and second, spread apart stabilizer plates at the bottom of the pivot head engage the edge of the lid as it is removed.

As can be seen in FIG. 4, the stabilizer plates 22*a*, 22*b* are formed by outwardly flared or spread portions of the two side plates 36*a*, 36*b*, in the area generally below and behind the lifting arm 30. The stabilizers serve to arrest upward and rearward movement of the lid: as the lid is lifted and removed, generally horizontal shoulders 54 at the back of the lifting arm abut the top of the lid so as to arrest vertical movement, and generally vertical faces of the stabilizer plates abut the outer edge 56 of the lid to limit rearward and lateral movement. In conjunction with the hook member 16, the stabilizers form a "three point" connection to the lid which effectively prevents any rocking or wobbling motion while the lid is being raised/lowered or transported. Furthermore, the bottoms of the stabilizing plates are preferably provided with downwardly extending, rounded tabs 57*a*, 58*b* at their leading edges which engage the ground adjacent to the manhole during the initial phase of the lifting movement, until the weight is transferred onto the wheels 24 which provide the main pivot axis.

Figure 5:
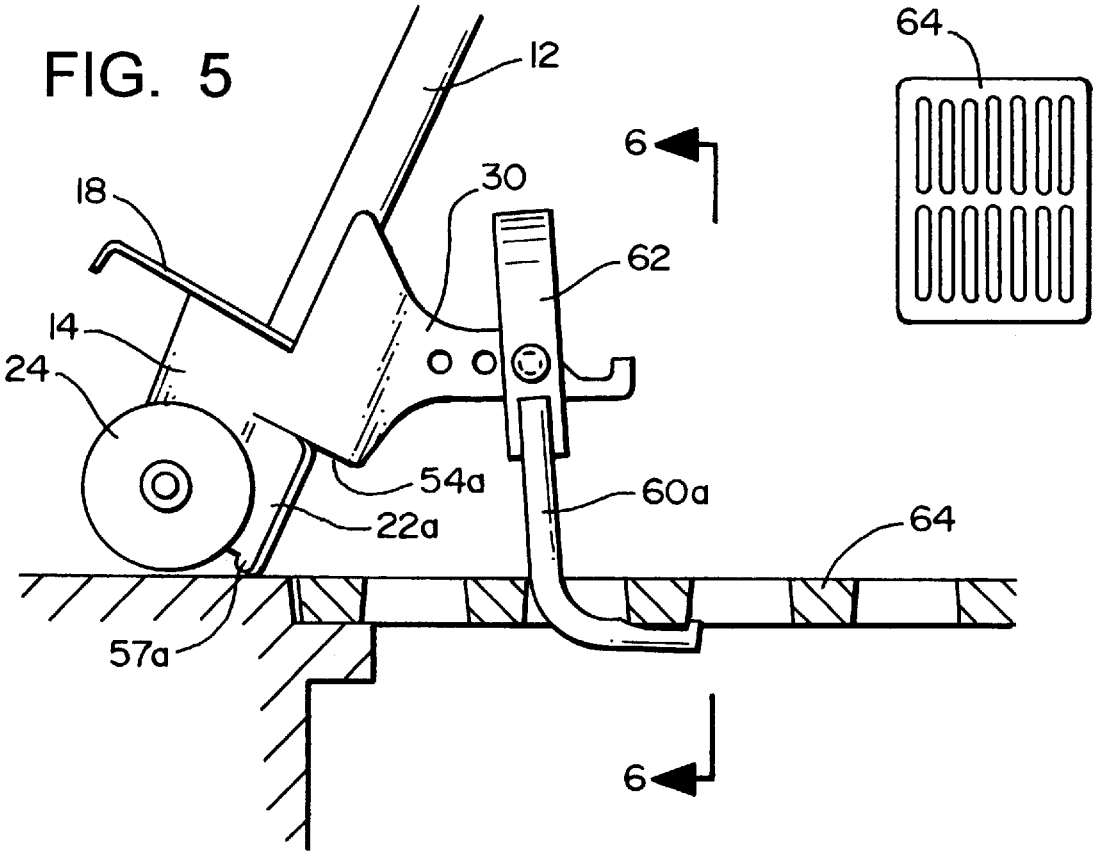
FIG. 5 is a side, elevational view showing the pivot head of the tool of FIGS. 1–4, but fitted with a second, two-pronged hook member which is configured for removal of grates and similar types of lids.
Figure 6:
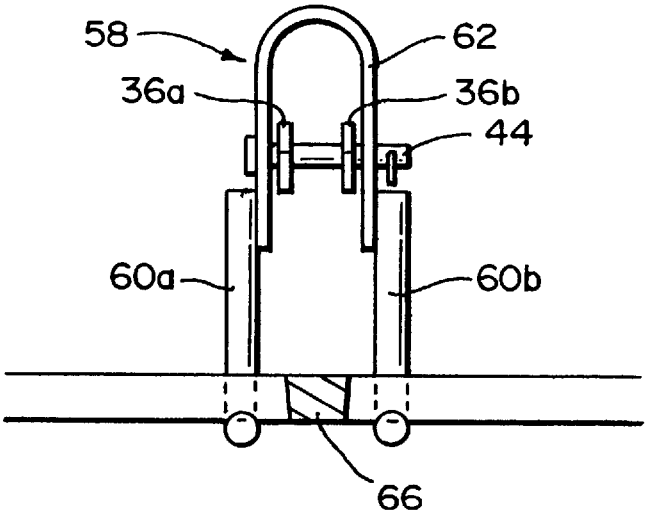
FIG. 6 is a front, elevational view of the two-pronged hook member of FIG. 5, showing the manner in which this fits between the bars of a grate to be removed.

FIGS. 5–6 show the lifting tool 10 fitted with another form of hook member 58, this having first and second prongs 60*a*, 60*b* which are joined by an upper hoop 62. Each of the prongs is generally similar to the single prong described above, and the hook member 58 can be mounted to the frame 58 interchangeably with the single-pronged hook 16, with the two vertical legs of the hook 58 fitting fairly close against the outside of the plates 36*a*, 36*b* for stability. The two-pronged hook member 58 is particularly adapted for removal/replacement of heavy gratings, such as the grate 64 which is shown in FIG. 5, with the spacing between the prongs being selected so that these will enter separate, laterally-spaced openings in the grate (see FIG. 6). It will be understood that other, specially configured hook members can also be provided for use with a variety of other types/styles of lids and lift fittings.

Figure 7:
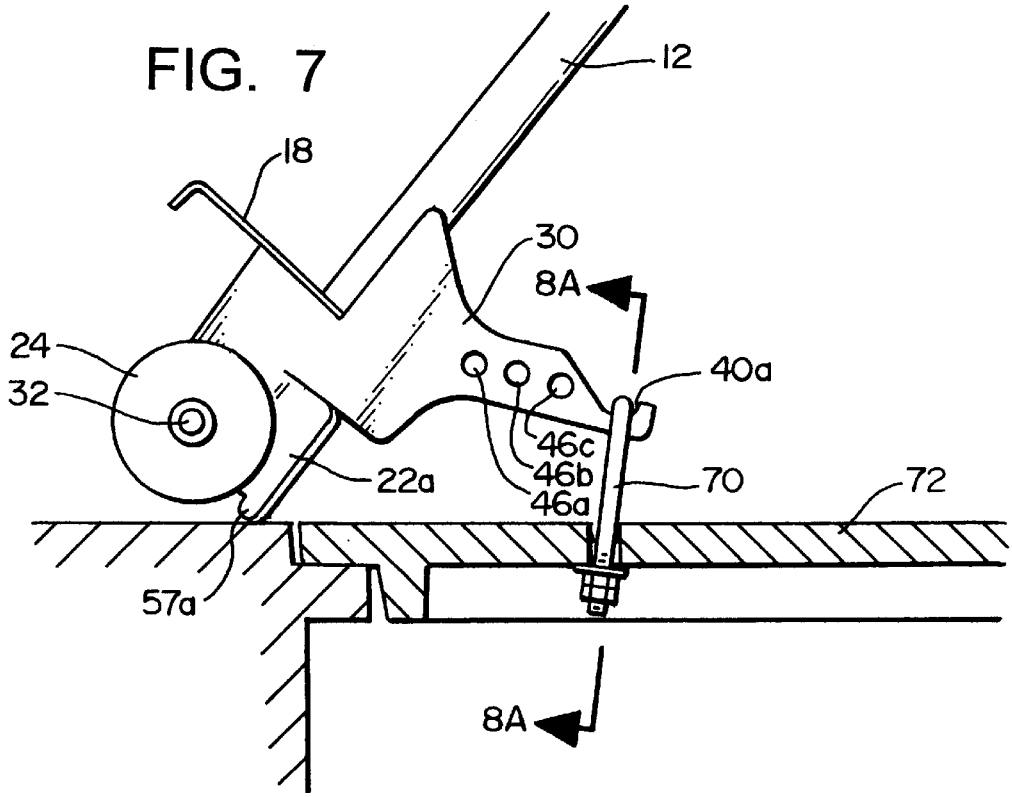
FIG. 7 is a side, elevational view of the tool of FIGS. 1–5, but with the pivoting hook members removed, showing the manner in which a lid having a D-ring handle is lifted and removed using fixed hook portions which are formed on the forward end of the pivot head of the tool.

FIG. 7, in turn, illustrates the use of the fixed hooks 40*a*, 40*b* which are formed at the forward end of the lifting arm 30. As was noted above, the fixed hooks are configured principally for removing manhole covers and other lids which are fitted with "D" type lifting rings, rather than having holes or other openings as shown above, for ease of use, the pivoting hook member 16, can be removed when the fixed hook portions are to be used. Accordingly, FIG. 7 shows the D-ring handle 70 of such a lid 72 having been raised and placed over fixed hooks 40*a*, 40*b*, with the pivot head being tilted in the forward direction.

Figure 8A:
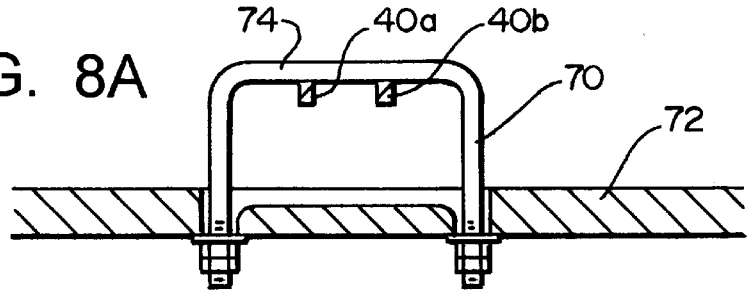
FIGS. 8A–8B are sequential, cross sectional views showing the D-ring handle of the lid in raised and lowered positions.

As can be seen in FIG. 8A the fixed hooks 40*a*, 40*b* engage the upper leg 74 of the D-ring at separate, laterally spaced locations. This stabilizes the lid against rocking or slipping back and forth during the initial phases of the lifting motion, until the stabilizer plates and shoulders come into contact with the edge of the lid.

Figure 8B:
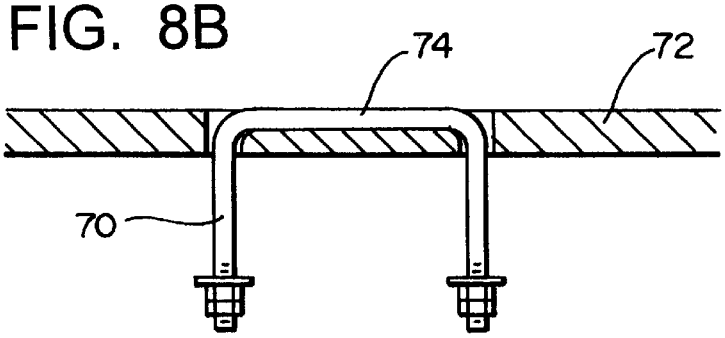

With the D-ring thus engaged by the fixed hooks, the operator pulls back on the handle of the tool and applies downward pressure on the footplate 18, raising and removing the lid in the same manner as described above. When the lid is returned to its opening, the hooks are removed from the D-ring, which then falls back to its retracted position, as shown in FIG. 8B.

Figure 9A:
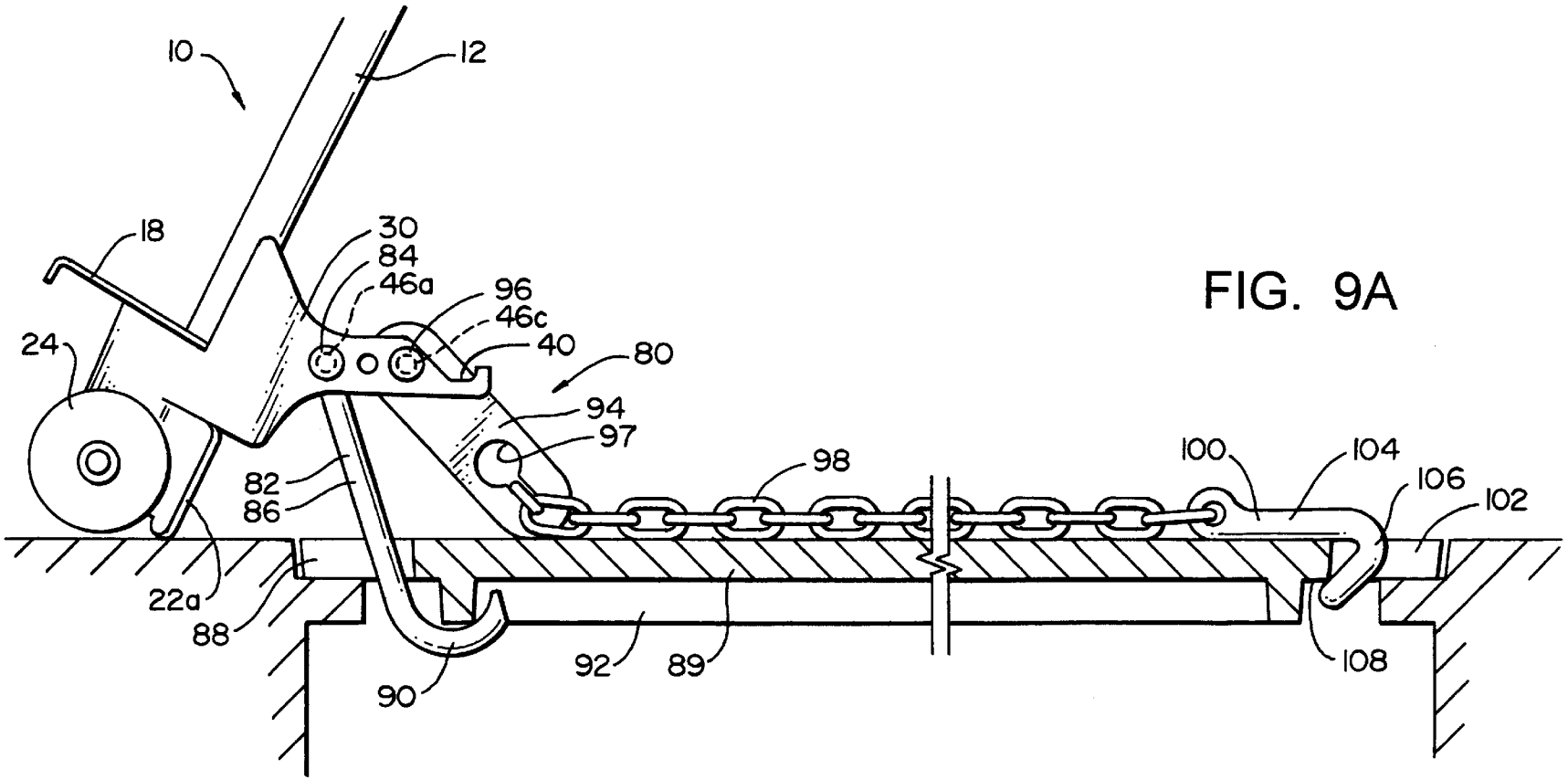
FIGS. 9A–9B are sequential, elevational views showing the pivot head of the tool of FIGS. 1–5 fitted with a J-hook and chain attachment for use with large diameter lids having perimeter openings, and showing the manner in which this is used to raise and remove such lids.
Figure 9B:
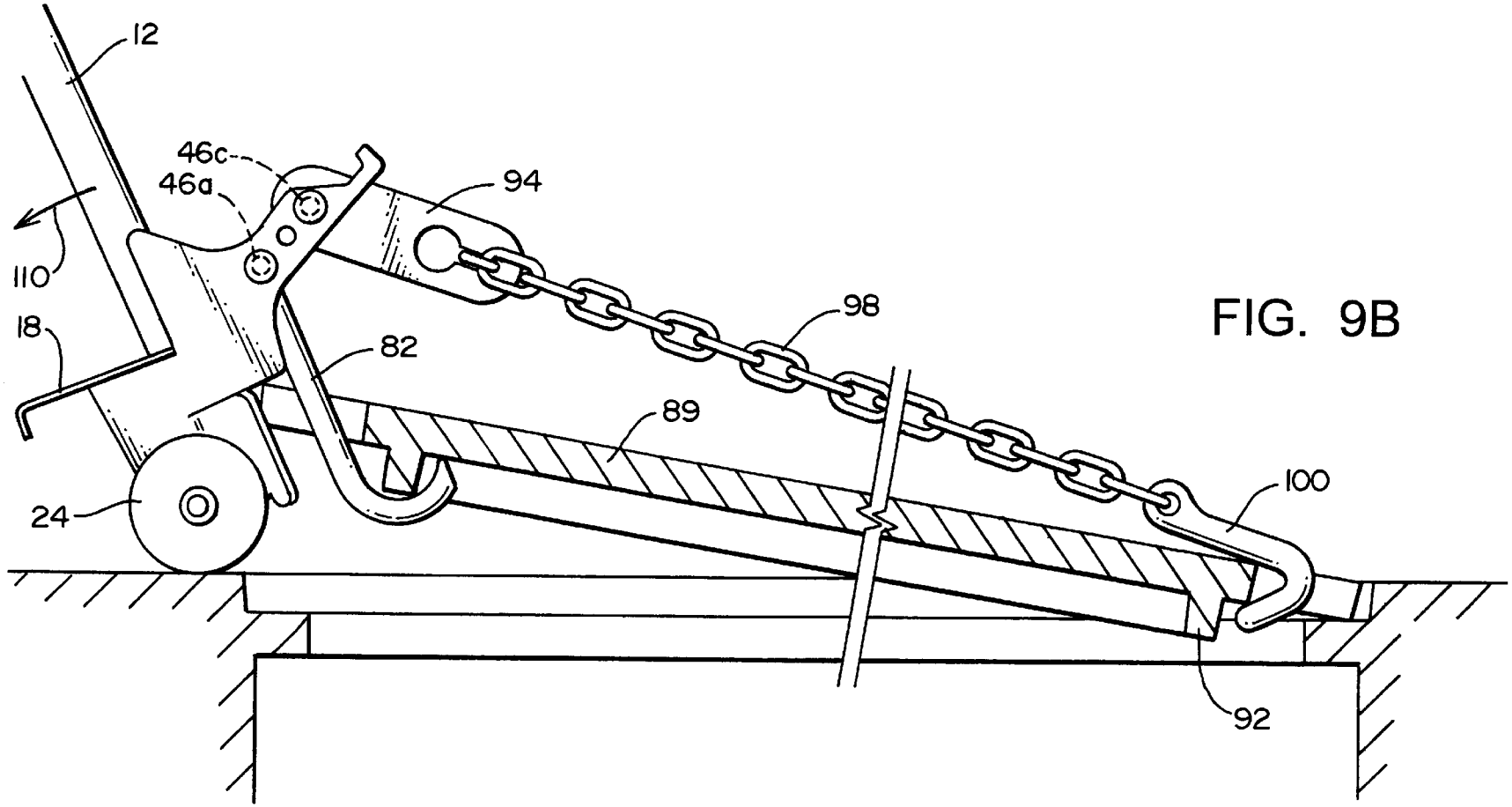

FIGS. 9A–9B show the lifting tool 10, fitted with a hook-and-chain attachment for removal of comparatively large lids, such as large utility covers. Such covers are commonly on the order of 36 inches in diameter, and can weigh in the hundreds of pounds. The tool of the present invention, using the hook and chain attachment which is shown in FIGS. 9A–9B, has been demonstrated to generate a lifting ratio, of approximately 4:1 making it possible for a single operator to remove such covers, which has heretofore been extremely difficult when using conventional tools.

As can be seen in FIG. 9A, the hook-and-chain attachment 80 includes a J-hook 82 which is mounted to the rearmost attachment point 36*a* of the lifting arm 30, using a first pin 84. The J-hook includes a comparatively long shank 86 which is sized to pass through a pick hole 88 at the edge of the lid 89, and a sharply curved lower end 90 which is configured to pass under and engage a downwardly extending ring 92 which is located a spaced distance inwardly from the edge of the lid. The pick hole and ring are conventional features of utility covers and similar lids, being provided for use with an ordinary pry-bar.

A pivoting link 94, in turn, is mounted to the forward attachment point 46*c* on lifting arm 30, using a second pin 97. The lower end of the length includes a keyhole opening 96 through which a link of chain 98 is passed; the keyhole opening allows for adjustment of the length of the chain which spans the top of the lid, and a ring or fitting (not shown) is preferably attached to the other end of the chain to prevent it from falling out of the link during transportation or storage. An edge hook 100 is attached to the outer end of the chain, and is configured to pass through a corresponding pickhole 102 on the opposite side of the lid from J-hook 90. As can be seen, the shank 104 of edge hook, lies generally flat on the top of the lid 89 while its end 106 extends downwardly through the pick opening to engage a rim portion 108 of the lid.

To use the tool, the operator inserts the J-hook into the first pickhole and rotates it so that the lower end of the hook engages the inner ring. The chain hook 100 is then set in the second pickhole opposite the first, and the chain length is adjusted so that the handle is approximately 45° to 60° to the ground when the chain is tensioned and the link 94 pivots outwardly as shown in FIG. 9B. Then, using both hands, the operator grasps the handle of the tool and draws it towards the center of his chest, in the direction indicated by arrow 110 in FIG. 9B, using his body weight to pull downwardly and outwardly to raise and slide the cover from the access hole. To replace the cover, the chain hook is released, and while holding, the chain the pivot head 14 of the tool is used to lift one edge of the lid and push it back into the access hole. The J-hook is then disengaged from the inner ring and withdrawn.

The tool of the present invention may be formed of any sufficiently strong and durable material, with welded steel being eminently suitable for this purpose.

It is to be recognized that various alterations, modifications, and/or additions may be introduced into the constructions and arrangements of parts described above without departing from the spirit or ambit of the present invention.

What is claimed is:

1. An apparatus for lifting and removing lids, said apparatus comprising:

an elongate lever having a handgrip area at an upper end thereof for application of force in a rearward and downward direction;

at least one wheel mounted to a lower end of said lever for resting on an underlying surface so as to provide a generally horizontal pivot axis, said at least one wheel being mounted so that said pivot axis which is formed thereby is positioned behind a long axis of said elongate lever, said wheel further being configured to form a rolling axis for transporting a lid over said underlying surface after lifting and removal;

a foot plate mounted to said lower end of said lever rearwardly of said pivot axis for application force in a downward direction;

a lifting arm mounted to said lower end of said elongate lever; and at least one hook member mounted to said lifting arm forwardly of said pivot axis for engaging and raising a lid in response to said forces being applied in said rearward and downward directions to said lever and said footplate, a plurality of attachment points being provided for interchangeably and pivotably mounting said hook member at different distances from said long axis of said elongate lever so that said hook member is free to pivot rearwardly as a lid is lifted and removed said hook member.

2. The apparatus of claim 1, wherein said plurality of attachment points for mounting said hook member to said lifting arm comprises:

a plurality of spaced apart bores formed in said lifting arm; and at least one pivot pin for being selectively inserted through said bores in said lifting arm and a corresponding bore in said pin member.

3. The apparatus of claim 1, further comprising:

at least one fixed hook mounted on an outer end of said lifting arm for engaging and lifting a D-ring handle of a lid.

4. An apparatus for lifting and removing lids, said apparatus comprising:

an elongate lever having a handgrip area at an upper end thereof for application of force in a rearward and downward direction;

at least one wheel mounted to a lower end of said lever for resting on an underlying surface so as to provide a generally horizontal pivot axis, said at least one wheel being mounted so that said pivot axis which is formed thereby is positioned behind a long axis of said elongate lever, said wheel further being configured to form a rolling axis for transporting a lid over said underlying surface after lifting and removal;

a foot plate mounted to said lower end of said lever rearwardly of said pivot axis for application of force in a downward direction;

a lifting arm mounted to said lower end of said elongate lever;

at least one hook member mounted to said lifting arm forwardly of said pivot axis for engaging and raising a lid in response to said forces being applied in said rearward and downward directions to said lever and said footplate, said hook member being pivotably mounted to said lifting arm so that said hook member is free to pivot rearwardly as a lid is lifted and removed thereby; and means for stabilizing a lid as said lid is lifted and removed by said hook member, said means for stabilizing a lid comprising first and second outwardly extending stabilizing plates mounted to said lower end of said lever below said lifting arm for engaging an edge surface of said lid as said lid is lifted and removed by said pivoting hook member.

5. An apparatus for lifting and removing lids, said apparatus comprising:

an elongate lever having a handgrip area at an upper end thereof for application of force in a rearward and downward direction;

at least one wheel mounted to a lower end of said lever for resting on an underlying surface so as to provide a generally horizontal pivot axis, said at least one wheel being mounted so that said pivot axis which is formed thereby is positioned behind a long axis of said elongate lever, said wheel further being configured to form a rolling axis for transporting a lid over said underlying surface after lifting and removal;

a foot plate mounted to said lower end of said lever rearwardly of said pivot axis for application of force in a downward direction;

a lifting arm mounted to said lower end of said elongate lever; and at least one hook member mounted to said lifting arm forwardly of said pivot axis for engaging and raising a lid in response to said forces being applied in said rearward and downward directions to said lever and said footplate, said hook member comprising a first hook member mounted at a rearward position on said lifting arm for engaging a first opening on a rear side of a lid and a second hook member mounted at a forward position on said lifting arm for engaging a second opening on a far side of said lid.

6. The apparatus of claim 5, wherein said second hook member comprises:

an elongate flexible member having a first end mounted to said lifting arm; and a hook mounted to a second end of said elongate flexible member for engaging said second opening in said lid.

7. The apparatus of claim 6, further comprising:

means for adjusting a length of said elongate flexible member so as to correspond to a width of said lid.

8. The apparatus of claim 7, herein said elongate flexible member comprises:

a section of flexible chain.

9. The apparatus of claim 8, wherein said means for adjusting said length of said flexible member comprises:

a link member having a keyhole opening for selectively engaging said section of chain.

10. The apparatus of claim 9, wherein said link member is pivotally mounted to said lifting arm.

* * * * *